United States Patent [19]

Vallera

[11] 4,235,589

[45] Nov. 25, 1980

[54] FLAME-LIMITING DEVICE FOR A GAS LIGHTER

[75] Inventor: Joseph J. Vallera, Melrose, Mass.

[73] Assignee: The Gillette Company, Boston, Mass.

[21] Appl. No.: 15,848

[22] Filed: Feb. 27, 1979

[51] Int. Cl.[3] ..... F23D 13/04

[52] U.S. Cl. ..... 431/344; 431/130; 431/143

[58] Field of Search ..... 431/344, 130, 131, 142, 431/143, 150, 254, 255, 276, 277

[56] References Cited

U.S. PATENT DOCUMENTS

| | | | |
|---|---|---|---|
| 3,286,491 | 11/1966 | Smith | 431/130 |
| 3,327,504 | 6/1967 | Smith | 431/130 |
| 3,860,385 | 1/1975 | Nakanishi | 431/344 |
| 4,177,646 | 12/1979 | Guadagnin et al. | 431/344 |

FOREIGN PATENT DOCUMENTS

| | | | |
|---|---|---|---|
| 1457631 | 10/1969 | Fed. Rep. of Germany | 431/344 |

*Primary Examiner*—Joseph Man-Fu Moy

*Attorney, Agent, or Firm*—Richard A. Wise; Mandel E. Slater

[57] ABSTRACT

A flame height limiting device for gas lighters is disclosed including a noncompressible permeable element (plug) through which the gas passes. This element is encased within a sleeve which is in contact only with materials of low thermal conductivity, but the permeable element and the sleeve are of high thermal conductivity. The plug is of non-uniform permeability and is oriented so that the permeability increases in the downstream direction of gas flow.

6 Claims, 2 Drawing Figures

FLAME-LIMITING DEVICE FOR A GAS LIGHTER

BACKGROUND OF THE INVENTION

1. Field of the Invention

This invention relates to liquefied gas lighters, and is directed more particularly to a device for limiting the flame height of a liquefied gas lighter.

2. Description of the Prior Art

Most known devices used for limiting the flame height of liquefied gas lighters include a permeable element offering a resistance to the flow of the gas, thus determining the rate at which gaseous fuel is fed to the flame and hence the height of the flame.

When the permeable body is noncompressible, for example in the case of a sintered metallic or ceramic material, its intrinsic flow resistance determines the maximum gas flow rate and hence the maximum flame height provided by the lighter. When used on its own, such a device furnishes a flame with a nonadjustable height. It may also be used in series with additional means for adjusting the gas flow rate in order to provide a lighter with both an adjustable flame and a maximum flame height limited to a preset value as determined by the noncompressible permeable body.

It has been suggested to construct gas lighters having a maximum flame height limited to a certain preset value by encasing a noncompressible permeable body within a sleeve of high thermal conductivity (over 40 kcal/m/h/°C.), which sleeve is in contact only with materials having low thermal conductivity (0.3 to 5 kcal/m/h/°C.), in order to insulate the permeable body from unwanted heat inputs emanating from the burner. Gas lighters of such construction have been found frequently to exhibit the disadvantage of an unsteady flame in which the flame height gradually and substantially increases during the course of a single "burn."

SUMMARY OF THE INVENTION

Accordingly it is the principal object of the present invention to provide a lighter of the type above described which exhibits a steady flame. A more specific object of the invention is to provide a lighter which does not exhibit the above-described growing flame problem.

With the above objects in view a feature of the present invention is the provision of a flame height limiting device for a gas lighter, which includes a noncompressible permeable element through which the gas passes, encased in fluid-tight relationship within a sleeve of high thermal conductivity, the sleeve being in contact only with materials of low thermal conductivity, in which the permeable element has a permeability which increases in the downstream direction. In a preferred embodiment of the invention the permeable element has a permeability gradient and is made of sintered metal. In another aspect the invention involves a method of making gas lighters of the above-described type in which the permeable element is first oriented for assembly into the lighter with the increased permeability end in the downstream direction.

The above and other features of the invention will now be more particularly described with reference to the accompanying drawing and pointed out in the claims. It will be understood that the particular device embodying the invention is shown by illustration only and not as a limitation of the invention.

BRIEF DESCRIPTION OF THE DRAWING

Reference is made to the accompanying drawing in which is shown an illustrative embodiment of the invention from which its novel features and advantages will be apparent.

DESCRIPTION OF A PREFERRED EMBODIMENT

Figure 1:
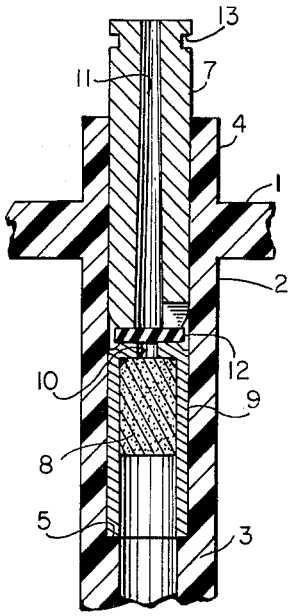
FIG. 1 is a partial axial cross section through a gas lighter with a flame-limiting device according to the invention.

Referring to the drawing and first to FIG. 1, there is shown a portion of a molded plastic gas lighter including body portion 1 and tube 2 molded integrally with body portion 1. Lower portion 3 of the tube 2 has an end (not shown) which communicates with a liquefied gas storage reservoir. As is well known within the art, communication with the fuel supply may alternatively be by means of a wick. Lower portion 3 of tube 2 has a smaller diameter than the upper portion 4, providing an internal shoulder indicated at 5.

Figure 2:
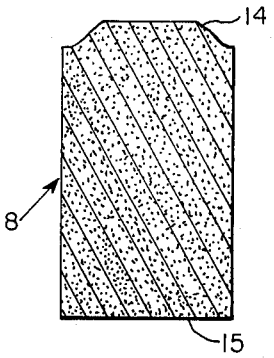
FIG. 2 is a cross section, on an enlarged scale, of the permeable element shown in FIG. 1.

A thimble-shaped aluminum sleeve 9 is force-fitted within tube 2 until it "bottoms" or rests on shoulder 5. An orifice 10 is formed in the otherwise-closed end of sleeve 9, and force-fitted within the sleeve in fluid-tight relationship is a sintered stainless steel (type 316) permeable element (plug) 8, of generally cylindrical shape, with a domed configuration 14 at its upper end (FIG. 2) and a flat lower end 15. Plug 8 has a permeability gradient such that the permeability increases in the downstream direction, or toward the top of the plug; and the domed configuration 14 at the more permeable end makes it convenient to identify that end by, for example, optical or mechanical inspection, and then orient the plug the correct way during assembly.

The manufacture of porous plugs such as described herein is well known to those skilled within the art of powder metallurgy and forms no part of the present invention. Such porous metal may be formed of powdered or finely divided particles of the desired metal, which have been compacted (to the desired porosity) and sintered together in such manner that fine interconnected pores will remain distributed therethrough, thereby providing a multitude of fine tortuous passages through which the gas may flow through the piece. In the flame height limiting device of the present invention a plug of substantially uniform porosity results in the growing flame problem described above, and this problem is worse if a plug with a porosity gradient is oriented with the more permeable end upstream in the gas flow, while the problem is substantially eliminated if the plug is oriented with the more permeable end downstream. In the gas lighter of the present invention it has been found convenient to specify, in order to produce an isobutane flame height of about 25 millimeters, that the plug have a nitrogen flow rate of 7.6 cc/min at 45 psig. Particularly good results are obtained (i.e., a steady flame) when, in a comparison of nitrogen flow rates similarly measured, the more permeable one-half of the plug has an average flow rate of about 38 cc/min and the less permeable one-half of the plug has an average flow rate of about 9.5 cc/min, the overall flow rate of the entire plug being the desired 7.6 cc/min.

In the present example plug 8 has an overall length (along the path of fluid flow) of about 2.0 mm and a diameter of 1.42 mm. The aluminum sleeve 9 has a length of 5.95 mm, an outer diameter of 2.94 mm, and an inner diameter of 1.46 mm. The orifice 10 is formed with a somewhat countersunk configuration and has a smallest diameter of 0.70 mm.

A burner 7 fits slidably within upper portion 4 of tube 2 and has an axial passage 11 running from one end to the other. In the valve-closed position the lower end of the burner rests on seal 12 which closes orifice 10. At the upper end of burner 7 a circular groove 13 is provided allowing for connection to means (not shown) allowing the burner to be raised when the lighter is activated.

In operation the burner is raised, unseating seal 12 from orifice 10. The combustible gas leaving the reservoir follows a path through lower portion 3 of tube 2, passes through sintered metal plug 8 in the direction of its increasing permeability, then exits orifice 10 and flows around now-unseated seal 12 and through axial passage 11 to the outside, where it is burned.

While various aspects of the invention have been illustrated by the foregoing detailed embodiment, it will be understood that various substitutions of equivalents may be made without departing from the spirit and scope of the invention.

What is claimed is

1. In a flame height limitation device for liquefied gas lighters including a noncompressible permeable plug through which the gas passes, said plug encased in fluid-tight relationship within a sleeve which is in contact solely with materials of low thermal conductivity, said plug and said sleeve having high thermal conductivity, the improvement which comprises: said permeable plug having a permeability which increases in the downstream direction.

2. Flame height limitation device as defined in claim 1, in which said permeable plug has a permeability gradient.

3. Flame height limitation device as defined in claim 1, in which said permeable plug is made of sintered metal.

4. A method of making a flame height limitation device for liquefied gas lighters which include a noncompressible permeable plug through which the gas passes, said plug having non-uniform permeability throughout its length and being encased in fluid-tight relationship within a sleeve which is in contact solely with materials of low thermal conductivity, said plug and said sleeve having high thermal conductivity, said method comprising: orienting said plug with its higher permeability in the downstream direction.

5. A method as defined in claim 4, in which said permeable plug has a permeability gradient.

6. A method as defined in claim 4, in which said plug is made of sintered metal.

* * * * *